US009496656B2

(12) United States Patent
Hsu et al.

(10) Patent No.: US 9,496,656 B2
(45) Date of Patent: Nov. 15, 2016

(54) CONDUCTIVE ATTACHMENT FOR SHIELDING RADIATION

(71) Applicant: Intel Corporation, Santa Clara, CA (US)

(72) Inventors: Hao-Han Hsu, Portland, OR (US); Kuan-Yu Chen, Hillsboro, OR (US); Xiang Li, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/573,007

(22) Filed: Dec. 17, 2014

(65) Prior Publication Data

US 2016/0181736 A1 Jun. 23, 2016

(51) Int. Cl.
*H01R 13/6594* (2011.01)
*H01R 13/658* (2011.01)
*H01R 43/20* (2006.01)

(52) U.S. Cl.
CPC ..... *H01R 13/6594* (2013.01); *H01R 43/20* (2013.01)

(58) Field of Classification Search
CPC ..... H01R 13/658; H01R 13/6591; H01R 13/6594; H01R 13/6595; H01R 13/6596
See application file for complete search history.

(56) References Cited

U.S. PATENT DOCUMENTS 6,231,356 B1 * 5/2001 Stutts ..... H01R 13/6485 439/607.28
6,450,837 B1 * 9/2002 Givens ..... H01R 13/65802 439/607.28
8,197,285 B2 * 6/2012 Farmer ..... H01R 12/712 439/607.3
8,672,710 B2 * 3/2014 Feldstein ..... H01R 13/6596 439/607.28
8,790,136 B2 * 7/2014 Duesterhoeft ..... H01R 13/6583 439/101
2013/0344739 A1 * 12/2013 Shih ..... H01R 13/658 439/607.28

* cited by examiner

*Primary Examiner* — Gary Paumen
(74) *Attorney, Agent, or Firm* — International IP Law Group, P.L.L.C.

(57) ABSTRACT

An apparatus is described. The apparatus includes an add-on conductive attachment that includes a single piece of material. The add-on conductive attachment is to suppress radiation from a connector. The apparatus includes a plurality of ground pads, where at least one end-portion of the add-on conductive attachment is to couple with a ground pad of a printed circuit board (PCB) via at least one of the ground pads.

17 Claims, 11 Drawing Sheets

100A

100B

100C

200A

200B

200C

300A

300B

400A

400B

500

CONDUCTIVE ATTACHMENT FOR SHIELDING RADIATION

TECHNICAL FIELD

The present techniques generally relate to a conductive attachment for mid-mount connectors. Specifically, the present techniques relate to an add-on conductive attachment disposed in an aperture located between a printed circuit board (PCB) and a connector shield.

BACKGROUND

A printed circuit board (PCB) includes various electronic components (e.g., transistors, integrated circuits, capacitors, switches, etc.) within a circuit and can provide a way of connecting those components within the circuit. The PCB may be connected to a connector that is designed to provide electrical connectivity for the various electronic components and other electrical devices located on the PCB and external to the PCB. However, electrical distortions, either radiated or conducted as electromagnetic interference (EMI) or radio frequency interference (RFI) from the connector, can disrupt PCB operations.

The connector may include a connector shell to reduce undesired electrical emissions coupled to other components on PCB, among other uses, as the PCB is exposed to vibration, contamination, and other external influences. The connector shell may be directly attached to the PCB as a way of protecting the electronic components of the PCB from EMI/RFI emissions radiating from the connector. However, due to structural limitations associated with the connector shell, an aperture may exist between the shell and the PCB. In some cases, the aperture may provide a pathway for increased radiation emissions from the connector, thus, possibly resulting in EMI/RFI risks and degradation in association with the PCB.

BRIEF DESCRIPTION OF THE DRAWINGS

Certain exemplary embodiments are described in the following detailed description and in reference to the drawings, in which.

The same numbers may be used throughout the disclosure and the figures to reference like components and features.

Figure 1A:
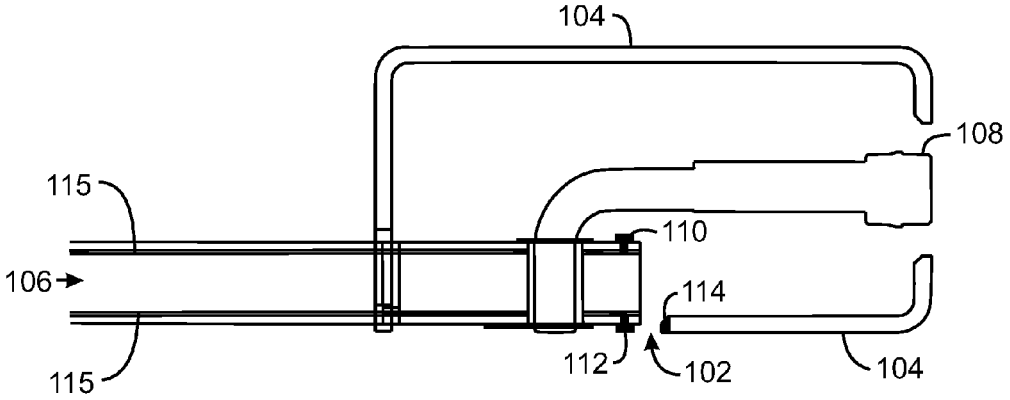
FIG. 1A is a diagram of an aperture between a connector shell and a PCB.

Numbers in the 100 series refer to features originally found in FIG. 1; numbers in the 200 series refer to features originally found in FIG. 2; and so on.

DETAILED DESCRIPTION OF SPECIFIC EMBODIMENTS

In the following description, numerous specific details are set forth, such as examples of specific types of configurations, specific hardware structures, specific architectural and micro-architectural details, specific system components associated with circuit boards, connectors, and the components of the circuit boards and connectors, in order to provide a thorough understanding of the present invention. It will be apparent, however, to one skilled in the art that these specific details need not be employed to practice the present invention. In other instances, well-known components or methods, such as specific and alternative circuit board and connector architectures, specific manufacturing techniques and materials, and other specific details have not been described in detail in order to avoid unnecessarily obscuring the present invention.

Although the following embodiments may be described with reference to mid-mount connectors, other embodiments are applicable to other types of circuit board connectors. Similar techniques and teachings of embodiments described herein may be applied to other types of PCB connectors that may also benefit from a decrease in radiation emissions. A circuit board connector may include a connector shell that is mechanically connected to a printed circuit board (PCB). The connector shell, as a component of the connector, is often used to combat the effects of radiation emitted from the connector, such as electromagnetic interference (EMI)/radio frequency interference (RFI), that can disrupt performance of other components or computer systems. The connector shell, in some examples, may be both electrically and mechanically connected to the PCB to act as a protection barrier to the PCB from EMI/RFI emissions. However, due to the design to attach the connector shell to the PCB, a path for EMI/RFI emissions, in the form of an aperture, may form between the connection. The radiation of EMI/RFI emissions via the aperture may lead to increased electrical distortions, and thus, possibility rendering the computer system operations less than optimal.

Some techniques to mitigate emissions and to seal the aperture include edge-sealing, board-edge plating, or side-plating of the PCB, the connector, or both, using a material. Various other deposition techniques, including chemical and vapor deposition, may be used to apply the material. Further, other techniques, such as soldering, spraying, or painting, among others, may be used. For example, a conductive metal, e.g., copper, may be electroplated onto a side-wall of the PCB in an effort to close the aperture. However, the plate thinness of the applied conductive metal and the costs associated with such techniques make it a less than desirable option. Additionally, the aforementioned techniques often apply the material in several layers, thus, problems associated with lift-off and material degradation, such as cracking and peeling, among others, are common during removal or normal wear-and-tear.

Embodiments of the present techniques relate to providing an add-on conductive attachment disposed in an aperture formed between a PCB and a connector shell, where the attachment is made of a single piece of material. According to the present techniques, the placement of the add-on conductive attachment to substantially seal the aperture may suppress EMI/RFI emissions radiating from the connector shell, and thus, possibly shield the computer system from the EMI/RFI risks.

FIG. 1A is a diagram 100A of an aperture 102 between a connector shell 104 and a PCB 106. A connector 108 is encased within the connector shell 104 and is used as a conductive path for electrical components located on the PCB 106 and external electrical components, in addition to a mechanical interface to provide strength to the PCB 106. As used herein, external refers to a location outside of a computer system that includes the PCB 106 and connector 108. In some examples, the connector 108 is a mid-mount connector. The connector 108 may be a plug or a socket that directly connects signal and power between the PCB 106 and the electrical components. The connector shell 104 is designed to be placed in close proximity to and connect physically and electronically to the PCB 106. In embodiments, the connector shell 104 may be designed to cover at least a portion of the connector 108 and the PCB 106, for example, where a bottom side of the PCB 106 and a front-face of the connector 108 are exposed.

Various sources may emit electromagnetic induction or electromagnetic radiation, both of which can affect electrical circuits and components on a circuit board. The connector 108 may be one source of EMI/RFI emissions since it acts as an antenna to radiate energy and as a conduit for conducted energy. The EMI/RFI radiated from the connector 108 can degrade, impair or prevent electrical circuit performance of surrounding components and devices connected to the PCB 106. In embodiments, the connector shell 104 is designed to suppress the undesired electrical emissions radiating from the connector 108 and may include different configuration, as shown in FIG. 1A. In some examples, the connector shell 104 may be made of a metal or a metal-coated plastic. In some cases, the metal may include iron, nickel, or any other type magnetic metal and its alloys.

The PCB 106 may include at least one pad, e.g., a ground pad, for example, a top pad 110 located on a top surface of the PCB 106 and a bottom pad 112 located on a bottom surface of the PCB 106. Accordingly, in some embodiments, the top pad 110 and the bottom pad 112 are connected to a ground plane of the PCB 106. The connector shell 104 may include at least one pad 114, for example, a ground pad, located proximate to a bottom portion of the shell 104.

As previously stated, in embodiments, the connector 108 may include a mid-mount connector. Mid-mount connectors often face difficulties associated with grounding and shielding, as opposed to other types of connectors, including top-mount and vertical mount connectors. For example, the height limitations and the placement of a connector shield 104 for a mid-mount connector in relationship to a PCB 106 may lead to the formation of the aperture 102. In some cases, the aperture 102 provides a pathway for the EMI/RFI emissions to radiate away from the connector 108. In embodiments, the connector 108 may include other types of PCB connectors, including a straddle-mount connector that can be implemented at the edge of the PCB 106.

Additional components may be added to or removed from FIG. 1A. The components of FIG. 1A may include any number of additional components not shown in FIG. 1A, depending on the details of the specific implementation. Further, the components of FIG. 1A may include less components than as shown in FIG. 1A, depending on the details of the specific implementation. For example, the PCB 106 may include a top pad 110 without the bottom pad 112.

Figure 1B:
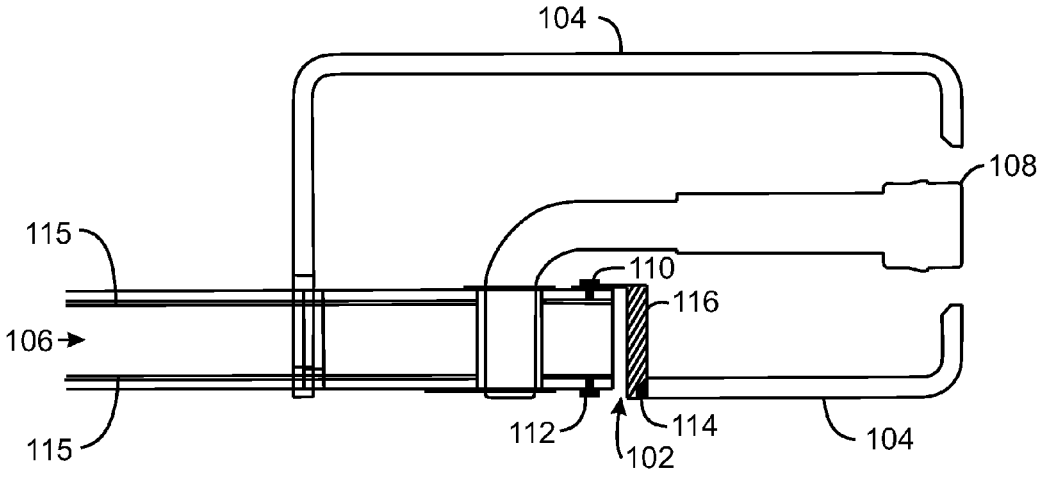
FIG. 1B is a diagram of an add-on conductive attachment disposed in the aperture between the connector shell and the PCB.

FIG. 1B is a diagram 100B of an add-on conductive attachment 116 disposed in the aperture 102 between the connector shell 104 and the PCB 106. Like numbers are as described with respect to FIG. 1A. An add-on conductive attachment may include a single piece of material that may be positioned within and removed from an aperture with minimum insertion and removal process steps. In particular, the add-on conductive attachment is a wholly solid piece of material that a user can position within the aperture in a single process step, without installing several component parts or without the need of several material-deposition layers. In some embodiments, the add-on conductive attachment may be clipped or soldered, among other types of techniques, to a PCB as a single, solid piece of material.

The add-on conductive attachment 116, for example, an L-shaped conductive attachment 116, when disposed in the aperture 102, may act as a type of shield to the PCB 106 and other electrical components by substantially sealing the aperture 102 to reduce EMI/RFI emissions radiating from the connector 108. In embodiments, the L-shaped conductive attachment 116 is made of a single piece of material that can be added to the connector 108 and shell 104 without additional parts or without the need of several deposition layers. For example, as illustrated in FIG. 1B, one end-portion of the L-shaped conductive attachment 116 is connected to the pad 114 of the connector shell 104. Another end-portion of the L-shaped conductive attachment 116 may be connected to the top pad 110 of the PCB 106. The pads 110 and 114 may include ground pads that are coupled to a ground plane 115 of the PCB 106. The ground plane 115 is an electrically conductive surface, e.g., copper, that embodies a zero ground potential. The ground plane 115 of the PCB 106 is connected to a power supply ground terminal (not shown) and serves as a return path for current from different electrical components on the PCB 106. In some examples, the ground plane 115 may provide noise reduction.

In embodiments, the L-shaped conductive attachment 116 may establish an electrical path from ground of the connector shell 104 to ground of the PCB 106. Based on this configuration, the L-shaped conductive attachment 116 may form a Faraday cage and thus, suppress EMI/RFI emissions radiating from the connector 108 and shield the PCB 106 and other electrical components from EMI/RFI emissions. A Faraday cage is an enclosure formed by a conducting material or by a mesh of such material to shield electrical components that it encloses from external static electric fields.

Additional components may be added or removed to FIG. 1B. The components of FIG. 1B may include any number of additional components not shown in FIG. 1B, depending on the details of the specific implementation. Further, the components of FIG. 1B may include less components than as shown in FIG. 1B, depending on the details of the specific implementation.

Figure 1C:
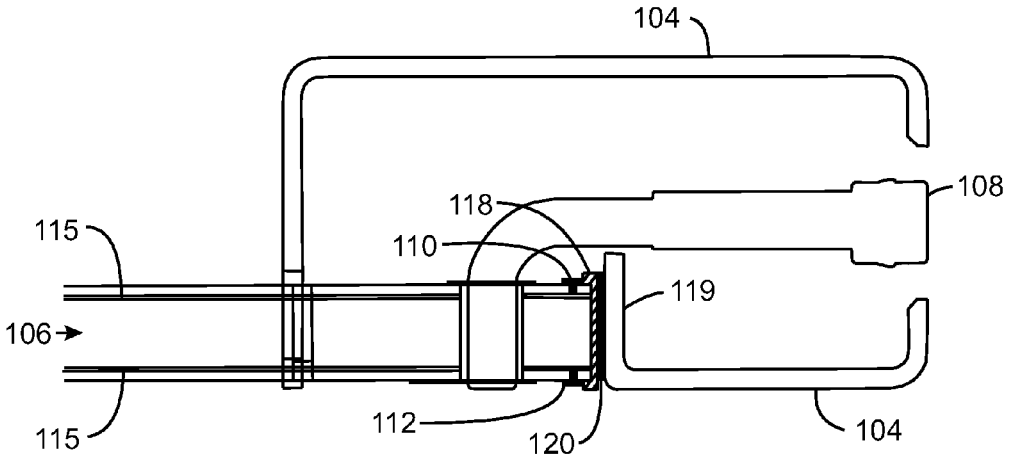
FIG. 1C is a diagram of an add-on conductive attachment disposed in the aperture between the connector shell and the PCB.

FIG. 1C is a diagram 100C of an add-on conductive attachment 118 disposed in the aperture (not shown) between the connector shell 104 and the PCB 106. Like numbers are as described with respect to FIG. 1A. The connector shell 104 may include various types of configurations. For example, as shown in FIG. 1C, an extending section 119 of the connector shell 104 is configured to extend upwards so as to be proximate a top portion of the PCB 106. Regardless of its configuration, the connector shell 104 is designed to suppress the undesired electrical emissions radiating from the connector 108.

An aperture (not shown) may exist between the extending section 119 of the connector shell 104 and the PCB 106. The aperture (not shown) may be substantially sealed by positioning the add-on conductive attachment 118, for example, a C-shaped conductive attachment 118, in the aperture to reduce EMI/RFI emissions that radiate from the connector shell 104.

The C-shaped conductive attachment 118 is made of a single piece of material that can be added to or removed from the PCB 106 without additional parts or without the need of several deposition layers. In embodiments, when positioned on the edges of the PCB 106, the C-shaped conductive attachment 118 may provide metal-to-metal contact with the top pad 110 and the bottom pad 112 located on the PCB 106. In examples, one end-portion of the C-shaped conductive attachment 118 may electrically connect to the top pad 110 of the PCB 106 and another end-portion of the C-shaped 118 may electrically connect to the bottom pad 112 of the PCB 106. In some aspects, the configuration of the C-shaped conductive attachment 118 may form a Faraday cage to substantially reduce the EMI/RFI emissions from the connector shell 104 and to shield the PCB 106 and other electrical components from EMI/RFI emissions.

Material joining techniques may be used to connect at least one surface of the conductive attachments 116 and 118 to at least one surface of the PCB 106. In some embodiments, to secure the L-shaped conductive attachment 116 within the aperture 102, soldering and electroforming techniques may be used. For example, soldering may be used to provide a secure attachment of the L-shaped conductive attachment between the pad 114 of the connector shell 104 and the top pad 110 of the PCB 106.

Likewise, material joining techniques, such as soldering, may be used to connect the C-shaped conductive attachment 118 to the top pad 110 and the bottom pad 112 of the PCB 106. For example, end portions of the C-shaped conductive attachment 118 may be soldered to the pads 110 and 112 of the PCB 106. In some embodiments, a clipping method may be used to secure the C-shaped conductive attachment 118 to the PCB 106 to substantially seal the aperture 102 of FIG. 1A. For example, the end portions of the attachment 118 may be positioned so as to be adjacent the top pad 110 and the bottom pad 112 of the PCB 106. The dimensions of the C-shaped conductive attachment 118 may be modified based on the dimension of the PCB 106 so that the attachment 118 is securely fitted around an end portion of the PCB 106, as shown in FIG. 1C, to provide a constant compression force to hold the attachment 118 in place. As a result, the clipping method may provide a spring force to ensure low contact-resistance between the PCB 106 and the C-shaped conductive attachment 118. To further mechanical contact between the C-shaped conductive attachment 118 and the connector 104, for example, an adhesive 120, such as a conductive adhesive or conductive foam, may be applied to the C-shaped conductive attachment 118. In some examples, the adhesive 120 may be applied to a side surface of the C-shaped conductive attachment 118 to obtain substantial contact with the connector shell 104.

The single piece of material used to fabricate the conductive attachments 116 and 118 may be based on several factors including conductivity, permeability, and wall thickness. In some embodiments, the conductive attachments 116 and 118 may include a magnetically and electrically conductive material. For example, the conductive attachments 116 and 118 may include stainless steel, tin-plated steel, copper alloys, and nickel-silver alloys, among others types of materials. In some cases, the single piece of material may be selected based on its ability to capture and absorb a portion of the radiated energy, as well as withstand material degradation due to environmental and operational effects. Additionally, the conductive attachments 116 and 118 may be made of a conductive-coated molded plastic. The conductive coating may include copper-nickel plating, copper/stainless steel vapor deposition, and aluminum vapor deposition, among others. Material shaping techniques including stamping, casting, rolling, and bending, among others, may be implemented to shape the L-shaped conductive attachment 116 and the C-shaped conductive attachment 118 into their respective configurations.

Additional components may be added or removed to FIG. 1C. The components of FIG. 1C may include any number of additional components not shown in FIG. 1C, depending on the details of the specific implementation. Further, the components of FIG. 1C may include less components than as shown in FIG. 1C, depending on the details of the specific implementation.

Figure 2A:
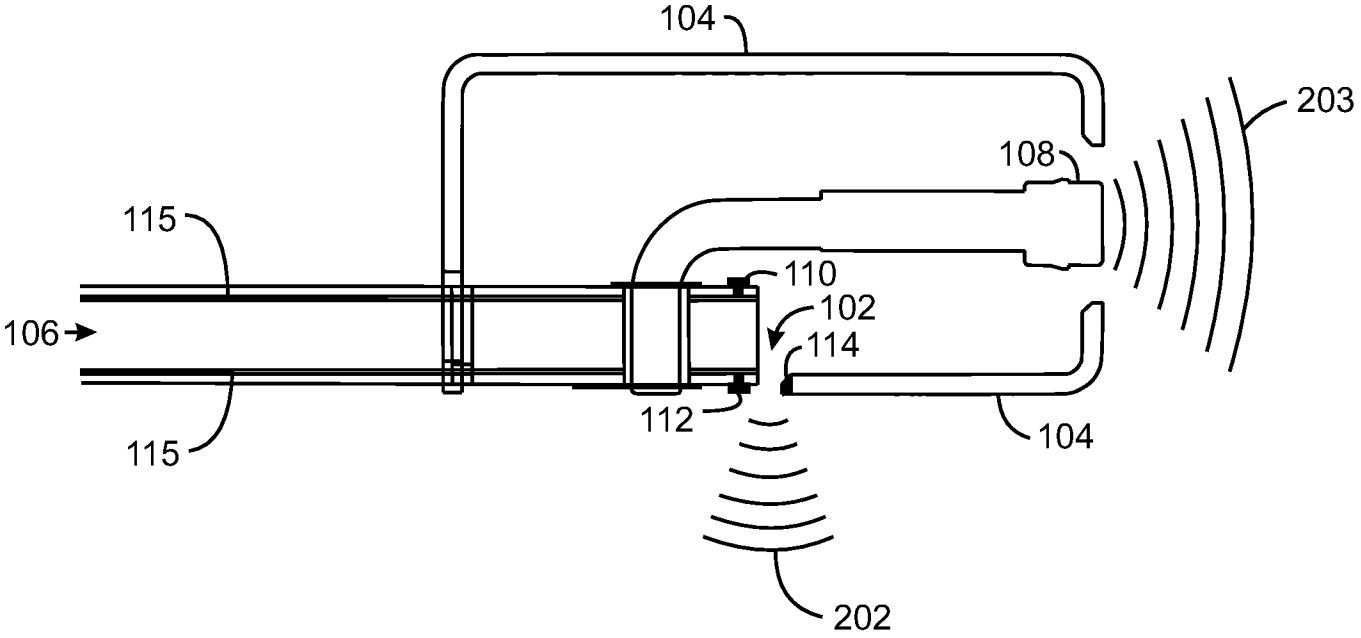
FIG. 2A is an illustration of an electric field proximate the aperture with respect to FIG. 1A.

FIG. 2A is an illustration of an electric field 202 proximate to the aperture 102 with respect to FIG. 1A. Like numbers are as described with respect to FIG. 1A. EMI/RFI emissions, depicted as an electric field 202, can be either conducted, meaning that the emissions are sent along power and signal lines, or radiated, meaning that the emissions propagate in free space. The electric field 202 may be an electric field wave generated by a periodically changing voltage potential. The electric field 202 depicts the magnitude of the radiation propagating from the connector 108 and through the aperture 102 formed between the PCB 106 and the connector shell 104. As shown in FIG. 2A, the aperture 102 provides an energy pathway or opening for discharge of the electric field 202. In some embodiments, the electric field 202 proximate the aperture 102 may be measured at about 5.0 Volt per meter (V/m). Further, the electric field 203 near the connector 108 may be measured at about 4.28 V/m to about 5.0 V/m.

Figure 2B:
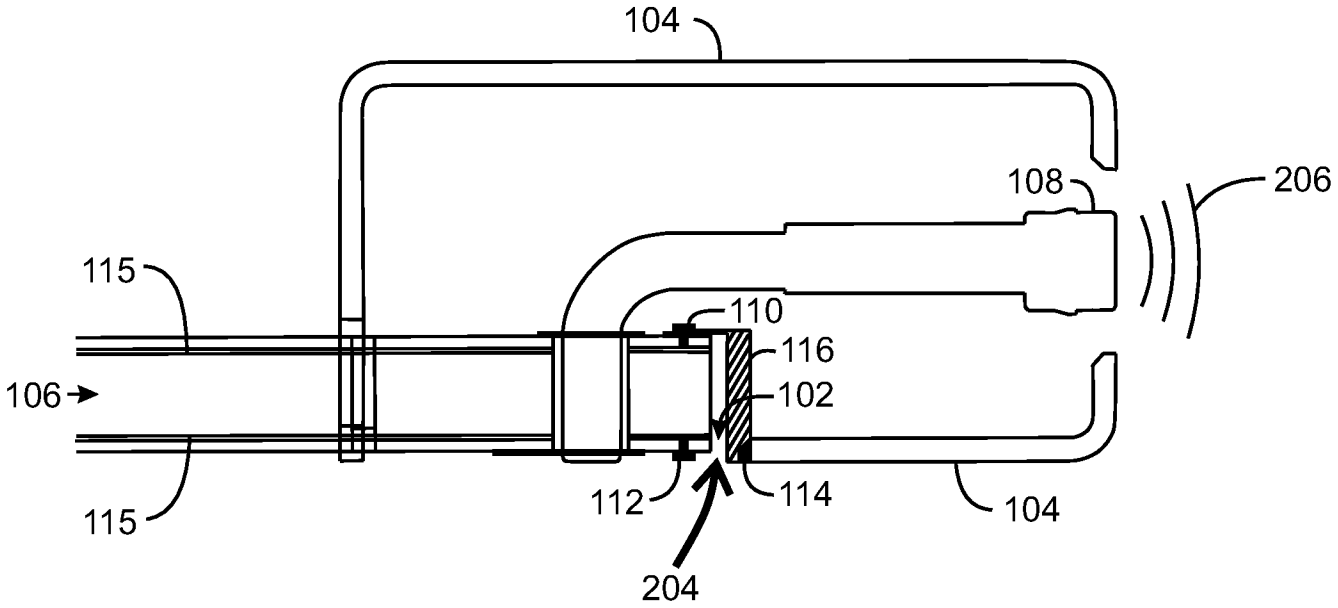
FIG. 2B is an illustration of a suppressed electric field with respect to FIG. 1B.

FIG. 2B is an illustration of a suppressed electric field with respect to FIG. 1B. Like numbers are as described with respect to FIG. 1B. As shown in FIG. 2B, the L-shaped conductive attachment 116 is positioned within the aperture 102 of FIG. 1B. As a result, the intensity of the EMI/RFI emissions exhibited is substantially less than the electric field 202 associated with FIG. 2A, where the aperture 102 does not include a conductive attachment. In some embodiments, an electric field proximate the L-shaped conductive attachment 116 may be non-existent, as indicated by arrow 204. As illustrated in FIG. 2B, the arrangement of the L-shaped conductive attachment 116 to seal the aperture 102 may substantially suppress EMI/RFI emissions and thus, suppress the electric field 202 of FIG. 2A. Additionally, due to substantially sealing the aperture 102 with the L-shaped conductive attachment 116, the electric field 206 near the connector 108 may decrease to about 3.57 V/m from about 4.90 V/m.

Figure 2C:
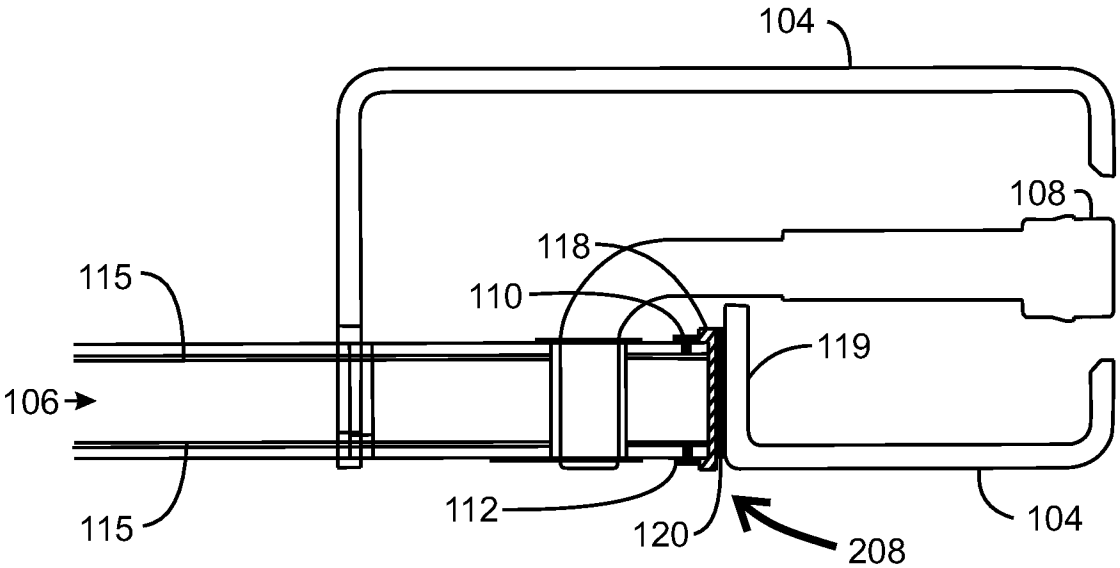
FIG. 2C is an illustration of a suppressed electric field with respect to FIG. 1C.

FIG. 2C is an illustration of a suppressed electric field with respect to FIG. 1C. Like numbers are as described with respect to FIG. 1C. As shown in FIG. 2C, the C-shaped conductive attachment 118 is implemented within the aperture 102 of FIG. 1C. As a result, the intensity of the EMI/RFI emissions exhibited is substantial less than the electric field 202 associated with FIG. 2A, where the aperture 102 does not include a conductive attachment. In some embodiments, an electric field proximate the C-shaped conductive attachment 118 may be non-existent, as indicated by arrow 208. The arrangement of the C-shaped conductive attachment 118 to seal the aperture 102 may substantially suppress EMI/RFI emissions and thus, suppress the electric field 202 of FIG. 2A.

In general, electrical interference, e.g., noise, is any unwanted electrical signal imposed on a component or computer system, e.g., radio module. Noise can be generated by multiple sources including nature, and other electrical devices. For example, switch mode power supplies inside of computers, monitors, and cell phones, among other types of electronic devices are often common sources of electrical noise that can interfere with the operation of the device. Noise is classified into two types of modes including common mode noise and differential mode noise. Common mode noise is defined as electrical interference that is found in both line and neutral conductors, with respect to ground, in the same direction. Differential mode noise is defined as electrical interference that exists between line and neutral conductors in opposite directions of each other.

Figure 3A:
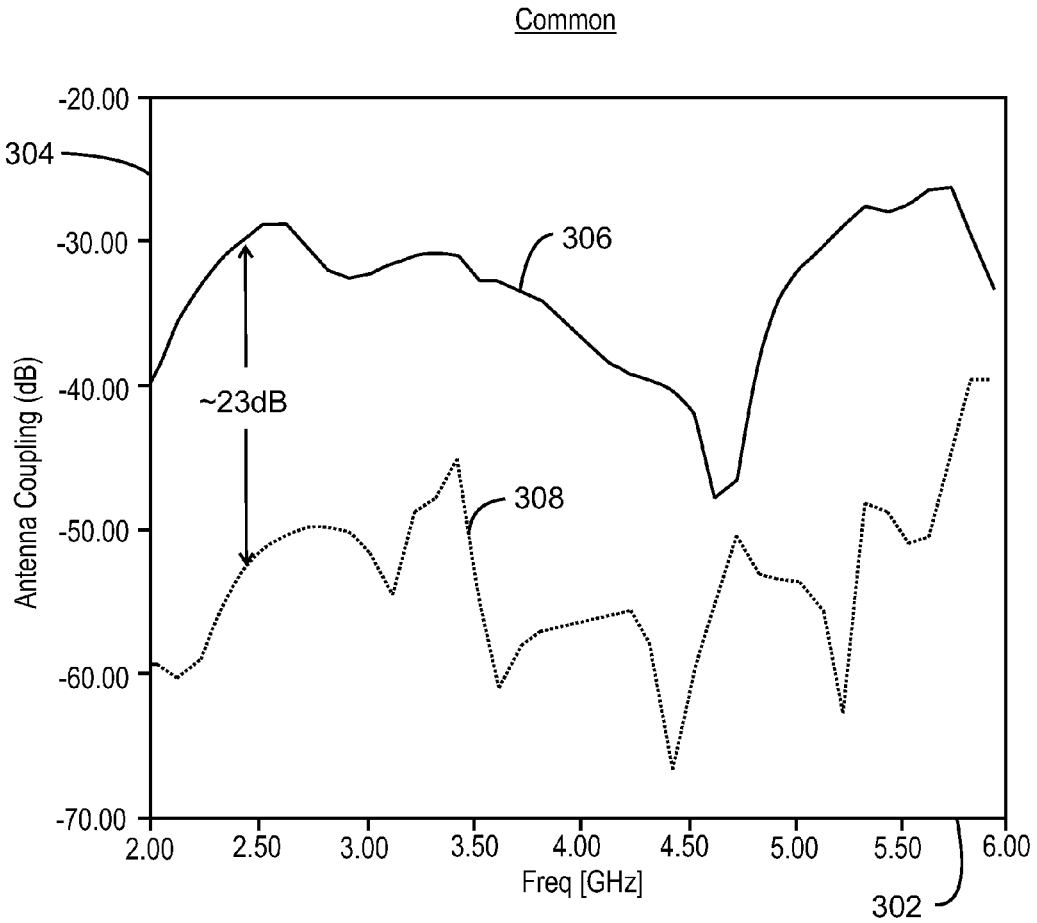
FIGS. 3A and 3B are plots of common mode signal and differential mode signal emissions, respectively, with and without the L-shaped conductive attachment.
Figure 3B:
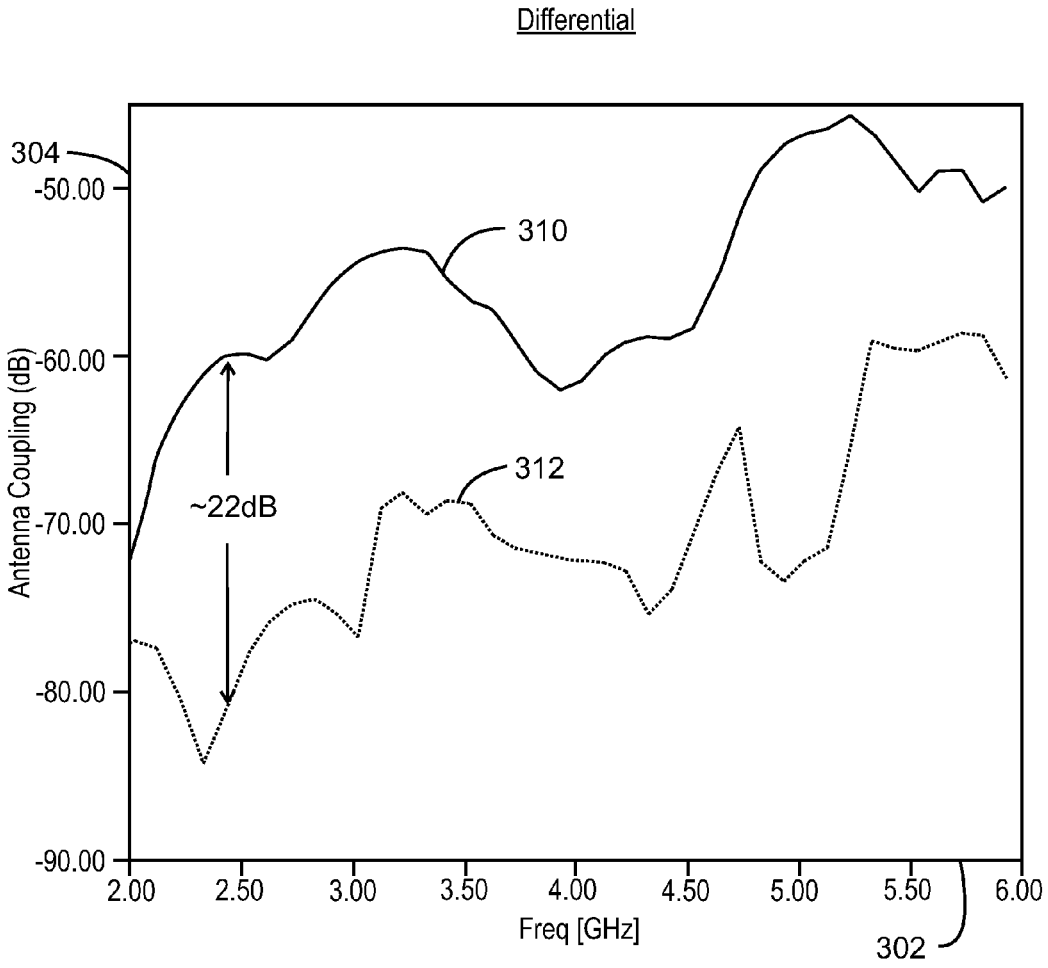

FIGS. 3A and 3B are plots of common mode signal and differential mode signal emissions, respectively, with and without the L-shaped conductive attachment 116. FIGS. 3A and 3B are described with respect to FIG. 1B. Accordingly, like numbers as described with respect to FIG. 1B, are used. The effectiveness of an L-shaped conductive attachment 116 within the aperture 102 located between the PCB 106 and the connector shell 104 may be quantified based on a simulation using noise coupling from the connector shell 104 and a nearby antenna. For example, the simulation included a WiFi antenna that was placed within a 25-mm distance from the connector shell 104. Common mode and differential mode signals were injected inside the connector shell 104 and the emission noise was received by the antenna.

A measure of the common mode signals received by the antenna is depicted in the plot of FIG. 3A. The x-axis 302 represents frequency in gigahertz (GHz), while the y-axis 304 represents antenna coupling in decibels (dB) to measure noise intensity received by the antenna. Line 306 depicts a measure of noise coupling without the insertion of the L-shaped conductive attachment 116. Line 308 depicts a measure of noise coupling with the insertion of the L-shaped conductive attachment 116. As depicted by the difference in noise intensity between line 306 and 308, the insertion of the L-shaped conductive attachment 116 to seal the aperture 102 may enable a reduction in the noise intensity that radiates from the connector shell 104. As shown in FIG. 3A, the difference in noise intensity for common mode signals may be measured at about 23 dB over a wideband from at least about 2 GHz to at least about 6 GHz.

A measure of the differential mode signals received by the antenna is depicted in the plot of FIG. 3B. A measure of noise coupling without the insertion of an L-shaped conductive attachment 116 is depicted by line 310. Line 312 depicts a measure of noise coupling with the insertion of the L-shaped conductive attachment 116. As depicted by the difference in noise intensity between line 310 and 312, the insertion of the L-shaped conductive attachment 116 to seal the aperture may aid in reducing the noise coupling that radiates from the connector shell 104. In particular, the insertion of the L-shaped conductive attachment 116 to seal the aperture may reduce the noise coupling by about 22 dB for differential mode signals over a wideband from at least about 2 GHz to at least about 6 GHz.

Figure 4A:
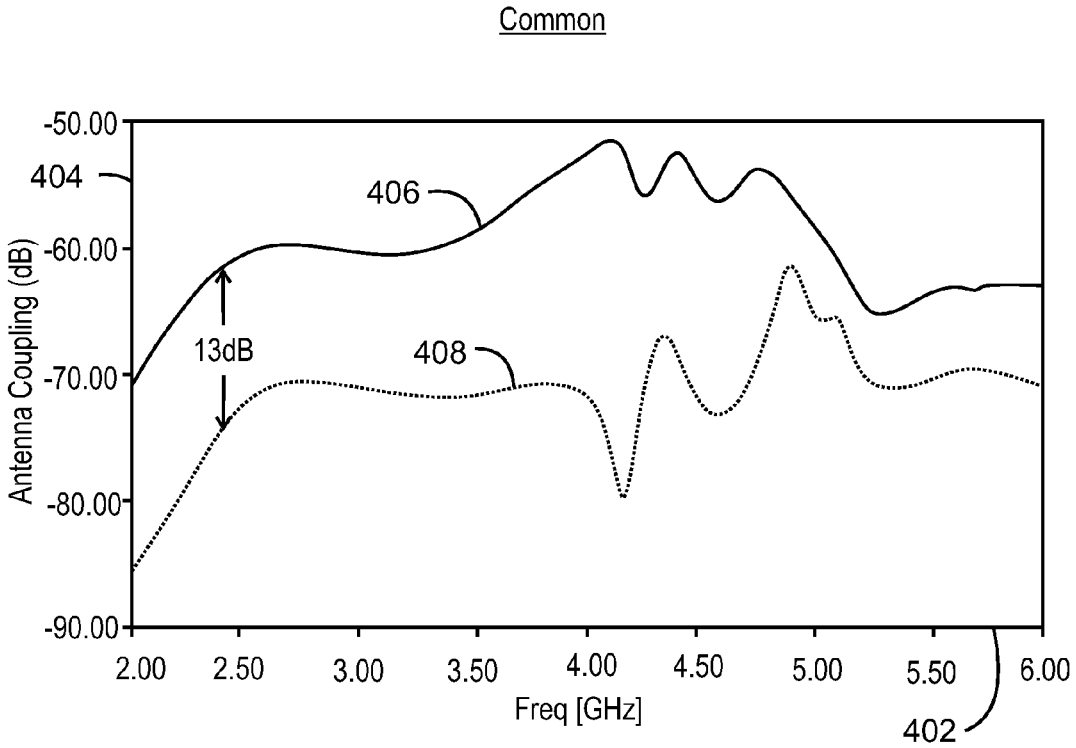
FIGS. 4A and 4B are plots of common mode signal and differential mode signal emissions, respectively, with and without the C-shaped conductive attachment.
Figure 4B:
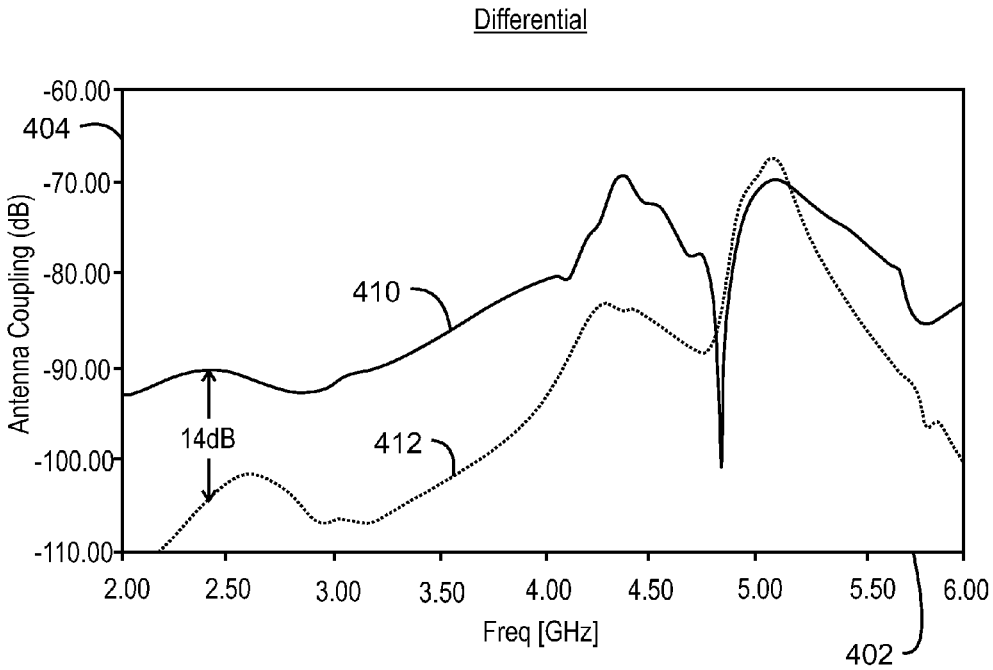

FIGS. 4A and 4B are plots of common mode signal and differential mode signal emissions, respectively, with and without the C-shaped conductive attachment 118. FIGS. 4A and 4B are described with respect to FIG. 1C. Accordingly, like numbers as described with respect to FIG. 1C, are used. The effectiveness of a C-shaped conductive attachment 118 within the aperture 102 located between the PCB 106 and the connector shell 104 may be quantified based on a simulation using noise coupling from the connector shell 104 and a nearby antenna. For the present embodiments, a WiFi antenna was placed within a 25-mm distance from the connector shell 104. Common mode and differential mode signals were injected into the connector shell 104 where the noise was received by the antenna.

A measure of the common mode signals received by the antenna is depicted in the plot of FIG. 4A. The x-axis 402 represents frequency in gigahertz (GHz), while the y-axis 404 represents antenna coupling in decibels (dB) to measure noise intensity received by the antenna. A measure of noise coupling without the insertion of a C-shaped conductive attachment 118 is depicted by line 406. A measure of noise coupling with the insertion of the C-shaped conductive attachment 118 is depicted by line 408. As depicted by the difference in noise intensity between line 406 and 408, the insertion of the C-shaped conductive attachment 118 to seal the aperture reduces the noise intensity radiating from the connector shell 104. Specifically, as shown in FIG. 4A, the difference in noise intensity for common mode signals may be measured at about 13 dB over a wideband from at least about 2 GHz to at least about 6 GHz.

A measure of the differential mode signals received by the antenna is depicted in the plot of FIG. 4B. A measure of noise coupling without the insertion of the C-shaped conductive attachment 118 is depicted by line 410. A measure of noise coupling with the insertion of the C-shaped conductive attachment 118 is depicted by line 412. As depicted by the difference in noise intensity between line 410 and 412, the insertion of the C-shaped conductive attachment 118 to seal the aperture aids in reducing the noise coupling that radiates from the connector shell 104. In particular, the insertion of C-shaped conductive attachment 118 to seal the aperture reduces the noise coupling by about 14 dB for differential mode signals over a wideband from at least about 2 GHz to at least about 6 GHz.

The conductive attachments, including the L-shaped conductive attachment 116 and the C-shaped conductive attachment 118, may be used as a shielding mechanism to form a conductive barrier to isolate the PCB and other electrical components and to reduce or prevent EMI/RFI emissions from the connector shell 104. As previously discussed, the L-shaped conductive attachment 116 may form a ground path between connector shell ground and PCB ground to form a Faraday cage. Likewise, the C-shaped conductive attachment 118 may provide substantial shielding between PCB ground and connector shell ground to form a Faraday cage. Due to its add-on nature that includes a single piece of material that can be implemented without additional parts or layer, the conductive attachments 116 and 118 may be implemented and removed as needed to mitigate EMI/RFI risks with minimum installation and removal issues.

Figure 5:
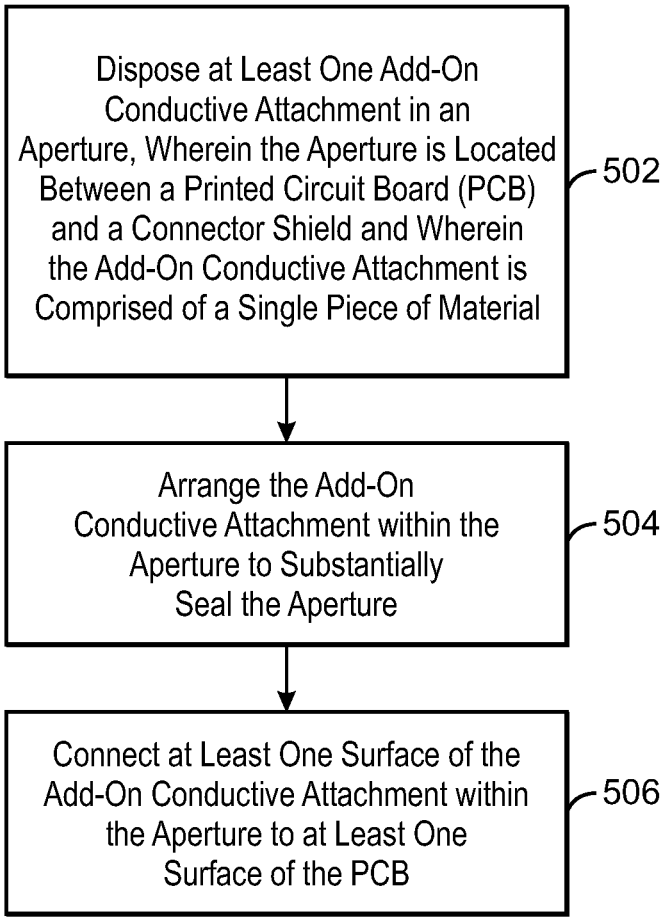
FIG. 5 is a block diagram of a method of using an apparatus.

FIG. 5 is a block diagram of a method of using an apparatus. The apparatus may be used to form a conductive barrier to suppress EMI/RFI emissions radiating from a connector. At block 502, at least one add-on conductive attachment may be disposed in an aperture, where the aperture is located between a PCB and a connector shell and where the add-on conductive attachment is comprised of a single piece of material. In some embodiments, the conductive attachment may be shaped to include an L-shape or a C-shape. Further, a number of the conductive attachments may be disposed in the aperture.

At block 504, the add-on conductive attachment may be arranged within the aperture to substantially seal the aperture. At block 506, at least one surface of the add-on conductive attachment within the aperture may be connected to at least one surface of the PCB.

The block diagram of FIG. 5 is not intended to indicate that the operations of the method 500 are to be executed in any particular order, or that all of the operations of the method 500 are to be included in every case. Additionally, the method 500 can include any suitable number of additional operations.

Example 1

An apparatus is described herein. The apparatus includes an add-on conductive attachment, wherein the add-on conductive attachment includes a single piece of material, and wherein the add-on conductive attachment is to suppress radiation from a connector. The apparatus includes a plurality of ground pads, wherein at least one end-portion of the add-on conductive attachment is to couple with a ground pad of a printed circuit board (PCB) via at least one of the ground pads.

The add-on conductive attachment is to substantially seal an aperture located between the PCB and the connector. The add-on conductive attachment is to form a Faraday cage with the connector. The add-on conductive attachment is designed to minimize mechanical interference with the PCB. The add-on conductive attachment is an L-shaped conductive attachment or a C-shaped conductive attachment. The L-shaped conductive attachment is to electrically connect the ground pad of the PCB to a ground pad of the connector. The C-shaped conductive attachment is to electrically connect the ground pad of the PCB to another ground pad of the PCB.

Example 2

A system is described herein. The system includes a printed circuit board (PCB) and a connector, wherein the connector comprises a connector shell. The system includes an aperture disposed between the PCB and the connector shell. The system includes at least one add-on conductive attachment disposed in the aperture, wherein the add-one conductive attachment is comprised of a single piece of material, and wherein the add-on conductive attachment is arranged within the aperture to substantially seal the aperture.

The single piece of material includes a single piece of metal or a single piece of plastic coated in metal, wherein the metal comprises any type of conductive metal or its alloys, in any combination, thereof. The add-on conductive attachment is to create an electrical path between the PCB and the connector shell. The add-on conductive attachment is shaped to form an L-shaped conductive attachment or a C-shaped conductive attachment. The L-shaped conductive attachment is to extend from a bottom portion of the connector shell to a top portion of the PCB. A bottom portion of the L-shaped conductive attachment is to connect to a bottom pad of the connector shell and wherein a top portion of the L-shaped conductive attachment is to connect to a top pad of the PCB. A top portion of the C-shaped conductive attachment is to connect to a top pad of the PCB and wherein a bottom portion of the C-shaped conductive attachment is to connect to a bottom pad of the PCB.

Example 3

A method of using an apparatus is described herein. The method includes disposing at least one add-on conductive attachment in an aperture, where the aperture is located between a printed circuit board (PCB) and a connector shell, and where the add-on conductive attachment is comprised of a single piece of material. The method includes arranging the at least one add-on conductive attachment within the aperture to substantially seal the aperture. The add-on conductive attachment may be arranged within the aperture to form a Faraday cage. The method includes connecting at least one surface of the add-on conductive attachment within the aperture to at least one surface of the PCB.

The single piece of material is shaped to form an L-shaped conductive attachment or a C-shaped conductive attachment. The method includes connecting one end-portion of the L-shaped conductive attachment to a bottom pad of the connector shell and connecting another-end portion of the L-shaped conductive attachment to a top pad of the PCB using a material joining technique. The method includes connecting one end-portion of the C-shaped conductive attachment to a top pad of the PCB and another end-portion of the C-shaped conductive attachment to a bottom pad of the PCB using a material joining technique. The method includes comprising applying a conductive adhesive or a conductive foam to the add-on conductive attachment within the aperture.

The L-shaped conductive attachment is arranged within the aperture to electrically connect the bottom pad of the connector shell to the top pad of the PCB. The C-shaped conductive attachment is arranged within the aperture to electrically connect the top pad of the PCB and to the bottom pad of the PCB.

While the present invention has been described with respect to a limited number of embodiments, those skilled in the art will appreciate numerous modifications and variations therefrom. It is intended that the appended claims cover all such modifications and variations as fall within the true spirit and scope of this present invention.

Use of the phrase 'to' or 'configured to,' in one embodiment, refers to arranging, putting together, manufacturing, offering to sell, importing and/or designing an apparatus, hardware, logic, or element to perform a designated or determined task. In this example, an apparatus or element thereof that is not operating is still 'configured to' perform a designated task if it is designed, coupled, and/or interconnected to perform said designated task. Note once again that use of the term 'configured to' does not require operation, but instead focus on the latent state of an apparatus and/or element, where in the latent state the apparatus and/or element is designed to perform a particular task when the apparatus and/or element is operating.

Furthermore, use of the phrases 'capable of/to,' and or 'operable to,' in one embodiment, refers to some apparatus and/or element designed in such a way to enable use of the apparatus and/or element in a specified manner. Note as above that use of to, capable to, or operable to, in one embodiment, refers to the latent state of an apparatus and/or element, where the apparatus and/or element is not operating but is designed in such a manner to enable use of an apparatus in a specified manner.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

In the foregoing specification, a detailed description has been given with reference to specific exemplary embodiments. It will, however, be evident that various modifications and changes may be made thereto without departing from the broader spirit and scope of the invention as set forth in the appended claims. The specification and drawings are, accordingly, to be regarded in an illustrative sense rather than a restrictive sense. Furthermore, the foregoing use of embodiment and other exemplarily language does not necessarily refer to the same embodiment or the same example, but may refer to different and distinct embodiments, as well as potentially the same embodiment.

What is claimed is:

1. An apparatus, comprising:

a C-shaped add-on conductive attachment that wraps around a printed circuit board (PCB) at an edge of the PCB nearest an upward-extending section of a connector shell, wherein the C-shaped add-on conductive attachment is comprised of a single piece of material, and wherein the C-shaped add-on conductive attachment is to suppress radiation from a connector; and a plurality of ground pads, wherein at least one end-portion of the C-shaped add-on conductive attachment is to couple with a ground pad of the PCB via at least one of the ground pads, and wherein the C-shaped add-on conductive attachment is to minimize mechanical interference with the PCB.

2. The apparatus of claim 1, wherein the C-shaped add-on conductive attachment is to substantially seal an aperture located between the PCB and the connector.

3. The apparatus of claim 1, wherein the C-shaped add-on conductive attachment is to form a Faraday cage with the connector.

4. The apparatus of claim 1, wherein the C-shaped add-on conductive attachment is to electrically connect the ground pad of the PCB to a metal shell of the connector.

5. The apparatus of claim 1, wherein the C-shaped add-on conductive attachment is to electrically connect the ground pad of the PCB to another ground pad of the PCB.

6. A system, comprising:

a printed circuit board (PCB);

a connector, wherein the connector comprises a connector shell an aperture disposed between the PCB and the connector shell; and at least one C-shaped add-on conductive attachment that wraps around the PCB at an edge of the PCB nearest an upward-extending section of the connector shell, wherein the C-shaped add-on conductive attachment is disposed in the aperture, wherein the C-shaped add-on conductive attachment is comprised of a single piece of material, wherein the C-shaped add-on conductive attachment is arranged within the aperture to substantially seal the aperture, and wherein the C-shaped add-on conductive attachment minimizes mechanical interference with the PCB.

7. The system of claim 6, wherein the single piece of material comprises a single piece of metal or a single piece of plastic coated in metal, wherein the metal comprises any type of conductive metal or its alloys, in any combination, thereof.

8. The system of claim 6, wherein the C-shaped add-on conductive attachment is to create an electrical path between the PCB and the connector shell.

9. The system of claim 6, wherein a top portion of the C-shaped add-on conductive attachment is to connect to a top pad of the PCB and wherein a bottom portion of the C-shaped add-on conductive attachment is to connect to a bottom pad of the PCB.

10. A method of using an apparatus, comprising:

disposing at least one C-shaped add-on conductive attachment in an aperture, wherein the C-shaped add-on conductive attachment wraps around a printed circuit board (PCB) at an edge of the PCB nearest an upward-extending section of a connector shell, wherein the aperture is located between the PCB and the connector shell, wherein the C-shaped add-on conductive attachment is comprised of a single piece of material, and wherein the C-shaped add-on conductive attachment minimizes mechanical interference with the PCB;

arranging the at least one C-shaped add-on conductive attachment within the aperture to substantially seal the aperture; and connecting at least one surface of the C-shaped add-on conductive attachment within the aperture to at least one surface of the PCB.

11. The method of claim 10, comprising connecting one end-portion of the C-shaped add-on conductive attachment to a top pad of the PCB and another end-portion of the C-shaped add-on conductive attachment to a bottom pad of the PCB using a material joining technique.

12. The method of claim 11, wherein the C-shaped add-on conductive attachment is arranged within the aperture to electrically connect the top pad of the PCB and the bottom pad of the PCB.

13. An apparatus, comprising:

an L-shaped add-on conductive attachment disposed in an aperture between a printed circuit board (PCB) and a connector shell, wherein the L-shaped add-on conductive attachment is comprised of a single piece of material, and wherein the L-shaped add-on conductive attachment is to suppress radiation from a connector; and a plurality of ground pads, wherein at least one end-portion of the L-shaped add-on conductive attachment is to couple with a ground pad of the PCB via at least one of the ground pads, and wherein the L-shaped add-on conductive attachment is to minimize mechanical interference with the PCB.

14. The apparatus of claim 13, wherein the L-shaped add-on conductive attachment is to substantially seal the aperture located between the PCB and the connector shell.

15. The apparatus of claim 13, wherein the L-shaped add-on conductive attachment is to form a Faraday cage with the connector.

16. The apparatus of claim 13, wherein the L-shaped add-on conductive attachment is to electrically connect the ground pad of the PCB to a metal shell of the connector.

17. The apparatus of claim 13, wherein a bottom portion of the L-shaped add-on conductive attachment is to connect to a bottom pad of the connector shell and wherein a top portion of the L-shaped add-on conductive attachment is to connect to a top pad of the PCB.

* * * * *